US012692112B2

(12) United States Patent
Hayashi et al.

(10) Patent No.: US 12,692,112 B2
(45) Date of Patent: Jul. 28, 2026

(54) SHEET CONVEYING APPARATUS AND IMAGE FORMING APPARATUS

(71) Applicant: CANON KABUSHIKI KAISHA, Tokyo (JP)

(72) Inventors: Hideki Hayashi, Saitama (JP); Jianxun Xie, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 207 days.

(21) Appl. No.: 18/595,763

(22) Filed: Mar. 5, 2024

(65) Prior Publication Data

US 2024/0351813 A1 Oct. 24, 2024

(30) Foreign Application Priority Data

Apr. 18, 2023 (JP) ..... 2023-067802

(51) Int. Cl.
*B65H 5/36* (2006.01)

(52) U.S. Cl.
CPC ..... *B65H 5/36* (2013.01); *B65H 2402/10* (2013.01); *B65H 2404/7414* (2013.01); *B65H 2801/21* (2013.01)

(58) Field of Classification Search
CPC ..... B65H 5/36; B65H 2402/10; B65H 2404/7414
See application file for complete search history.

(56) References Cited

U.S. PATENT DOCUMENTS 8,218,194 B2 * 7/2012 Murakami ..... B65H 5/38 399/323
11,554,926 B2 * 1/2023 Kakuta ..... B65H 37/04
2009/0073513 A1 3/2009 Murakami

FOREIGN PATENT DOCUMENTS

JP 2009067550 A 4/2009

* cited by examiner

*Primary Examiner* — Howard J Sanders
(74) *Attorney, Agent, or Firm* — ROSSI, KIMMS & McDOWELL LLP

(57) ABSTRACT

Disclosed is a sheet conveying apparatus to which a sheet conveying module is separably connected. The sheet conveying module is provided with a conveying unit including a conveying guide. The conveying unit can be pulled out in a direction perpendicular to a sheet conveying direction. The sheet conveying apparatus has a passing-over unit for passing the sheet over between the sheet conveying module and the sheet conveying apparatus. The passing-over unit includes a stopper member. The stopper member restricts a movement of the conveying unit in the pulling-out direction when the passing-over unit is in a first position. The restriction of the stopper member is released when the passing-over unit is in the second position.

17 Claims, 5 Drawing Sheets

SHEET CONVEYING APPARATUS AND IMAGE FORMING APPARATUS

BACKGROUND OF THE INVENTION

Field of the Invention

This invention relates to a sheet conveying apparatus and an image forming apparatus which forms an image on a sheet.

Description of the Related Art

In recent years, in the commercial printing field, where products output by an image forming apparatus are sold as merchandise, ability to use extensive kinds of recording materials and high productivity are required.

In terms of ability to use extensive kinds of recording materials, there is a need to support a wide range of recording materials from low stiffness sheet (e.g., ultra-thin sheet of 45-52 [g]) to high stiffness paper (e.g., ultra-thick paper of 500 [g]). In terms of high productivity, there is a demand for an image forming apparatus to rarely stop.

Therefore, it is necessary to prevent jams for a variety of sheets of paper, including paper with low stiffness and paper with high stiffness. It is necessary that jams do not occur, especially at joints between units that have guides that guide sheet and at areas where gaps are created between modules that are separably connected.

Japanese Patent Application Laid-Open No. 2009-67550 discloses an image forming apparatus in which a guide member is provided at the joint where a first conveying path and the second conveying path is separably connected to guide a recording material smoothly, so that bending, buckling, and damage of the recording material is prevented.

However, in the apparatus disclosed in Japanese Patent Application Laid-Open Nol. 2009-67550, the guide member overlaps with the conveyance path, so that the conveying path or the unit including the conveying path can only be pulled out in the direction along the sheet conveying direction, resulting in poor maintainability. In addition, in a large image forming apparatus with multiple modules connected in the conveying direction, when the unit should be pulled out in the direction perpendicular to the conveying direction, the module is required to be disconnected each time it is serviced, which takes time for maintenance.

SUMMARY OF THE INVENTION

A representative configuration of the present invention is a sheet conveying apparatus to which a sheet conveying module is separably connected, the sheet conveying module being provided with a conveying unit including a conveying guide configured to guide a sheet, the conveying unit being able to be pulled out in a pulling-out direction perpendicular to a sheet conveying direction, the sheet conveying apparatus comprising:

a passing-over unit configured to pass the sheet over between the sheet conveying module and the sheet conveying apparatus, the passing-over unit including a rotation central shaft and a conveying guide configured to guide the sheet and to be rotatable around the rotation central shaft, the passing-over unit being arranged on an upstream side or a downstream side of the conveying unit in the sheet conveying direction, wherein the passing-over unit is configured to be switched by rotation between a first position and a second position, the sheet is passed over in the first position of the passing-over unit, the conveying guide of the passing-over unit overlaps with the conveying guide of the conveying unit in the pulling-out direction when the passing-over unit is in the first position, and the conveying guide of the passing-over unit does not overlap with the conveying guide of the conveying unit in the pulling-out direction when the passing-over unit is in the second position, and wherein a stopper member is provided, which is configured to restrict a movement of the conveying unit in the pulling-out direction when the passing-over unit is in the first position, and the restriction of the stopper member to restrict the movement of the conveying unit in the pulling-out direction is released when the passing-over unit is in the second position.

Further features of the present invention will become apparent from the following description of exemplary embodiments with reference to the attached drawings.

DESCRIPTION OF THE EMBODIMENTS

Hereinafter, with reference to the drawings, preferable embodiments of the present invention will be described in detail. However, the dimensions, materials, shapes, and relative arrangement of the components described in the following embodiments should be changed as appropriate depending on the configuration and various conditions of the apparatus to which the invention is applied, and it is not intended to limit the scope of the invention to them alone.

<Inkjet Recoding Apparatus>

Figure 1:
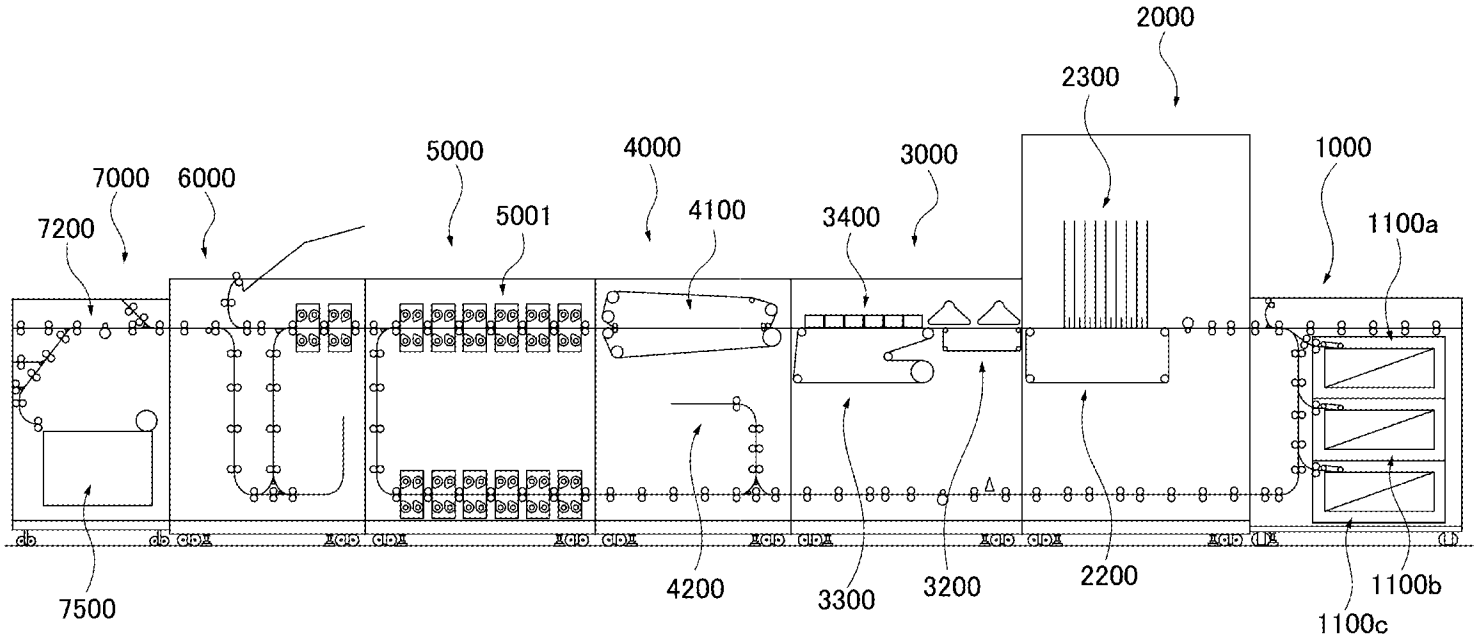
FIG. 1 is a schematic diagram showing the configuration of an image forming apparatus according to embodiment of the present invention.

Referring to FIG. 1, an inkjet recording apparatus, which is an embodiment of the present invention will be described below. FIG. 1 is a schematic diagram of an example of the configuration of an inkjet recording apparatus. This inkjet recording apparatus is a sheet-fed type inkjet recording apparatus that uses two liquids, a reaction fluid and ink, to produce a recording product that is formed as an ink image on a sheet S.

The inkjet recording apparatus of the present embodiment includes the sheet feeding module 1000, the printing module 2000, the drying module 3000, the fixing module 4000, the cooling module 5000, the reversing module 6000, and the sheet discharging and stacking module 7000. In the inkjet recording apparatus, each of the cut sheets S supplied from the sheet feeding module 1000 is conveyed along the conveying path, processed in each module, and discharged to the sheet discharging and stacking module 7000.

The sheet feeding module 1000 includes three storage cases 1100*a* to 1100*c* for storing sheets S. The storage cases 1100*a* to 1100*c* can be pulled out toward the front side of the apparatus in the direction perpendicular to the conveying direction of the sheets S. The sheets S are fed one at a time by a separation belt and conveying rollers in each of the storage cases 1100*a* to 1100*c*, and are conveyed to the printing module 2000. The number of storage cases 1100*a* to 1100*c* is not limited to three, but can be one, two, four, or greater than four.

The printing module 2000 includes a pre-image registration correction portion (not shown), the printing belt unit 2200, and the recording portion 2300. The inclination and the position of the sheet S conveyed from the sheet feeding module 1000 are corrected by the pre-image registration correction portion, and then the sheet S is conveyed to the printing belt unit 2200. The recording portion 2300 is positioned opposite the printing belt unit 2200 with respect to the conveying path. The recording portion 2300 is a sheet processing portion that performs recording processing (printing) on a sheet S to form an image by using a recording head from the above on the sheet S being conveyed. The sheet S is suctioned and conveyed by the printing belt unit 2200 to maintain clearance with the recording head. The multiple recording heads are arranged along the conveying direction. In this embodiment, there are a total of five line-type recording heads corresponding to the four colors of Y (yellow), M (magenta), C (cyan), Bk (black), and the reaction liquid. The number of colors is not limited to four and the number of recording heads is not limited to five. As an inkjet system, a system with a heat-generating element, a system with a piezoelectric element, a system with an electrostatic element, or a system with a MEMS (Micro Electro Mechanical Systems) element can be adopted. Ink of each color is supplied from an ink tank (not shown) to a corresponding recording head via an ink tube. The sheet S printed in the recording portion 2300 is conveyed by the printing belt unit 2200, and misalignment and color density of an image formed on the sheet S can be detected by an in-line scanner (not shown) located downstream of the recording portion in the conveying direction to correct the printing image.

The drying module 3000 includes the decoupling portion 3200, the drying belt unit 3300, and the hot air blowing portion 3400. The drying module 3000 is a unit that reduces the liquid content in the ink applied on the sheet S in the recording portion 2300 to improve the fixation between the sheet S and the ink. The sheet S printed in the recording portion 2300 of the printing module 2000 is conveyed to the decoupling portion 3200 located in the drying module 3000. In the decoupling portion 3200, the sheet S can be conveyed while being weakly held on the belt by wind pressure from above and belt friction, so that misalignment of the sheet S on the printing belt unit 2200, on which an ink image is formed can be prevented. While the sheet S is conveyed from the decoupling portion 3200 is sucked and conveyed by the drying belt unit 3300, hot air is applied to the sheet S from the hot air blowing portion 3400 located above the belt to dry the surface of the sheet S, on which ink is applied. In addition to blowing hot air, the drying system may include irradiating the surface of the sheet S with electromagnetic waves (such as ultraviolet ray and infrared ray), transferring conduction heat by contacting a heating element, or combination of these means.

The fixing module 4000 includes the fixing belt unit 4100, which allows ink to be fixed to the sheet S by passing the sheet S conveyed from the drying module 3000 between the heated upper and lower belt units.

The cooling module 5000 includes a plurality of cooling portions 5100 to cool the hot sheet S conveyed from the fixing module 4000. Each cooling portion 5100 is configured to cool the sheet S by drawing outside air into the cooling box with a fan to increase the pressure in the cooling box, and exposing the sheet S to air blown from nozzles formed on the conveying guide. The cooling portions 5100 are positioned on both sides of the conveying path and can cool the sheet S from both sides. In addition, the cooling module 5000 includes a conveying path switching portion, which can switch the conveying path of the sheet S depending on whether the sheet S should be conveyed to the reversing module 6000 or to the duplex conveying path used for duplex printing. During duplex printing, the sheet S is conveyed to the conveying path below the cooling module 5000 and is further conveyed along the duplex conveying paths of the fixing module 4000, the drying module 3000, the printing module 2000, and the sheet feeding module 1000. At this time, the front and rear sides of the sheet S are reversed by the first reversing portion 4200 in the duplex conveying portion of the fixing module 4000. The sheet S is then conveyed again to the pre-image registration correction portion of the printing module 2000, the printing belt unit 2200, and the recording portion 2300, where the printing is performed on the other side of the sheet S in the recording portion.

The reversing module 6000 includes the second reversing portion 6400, which can reverse the front and rear sides of the sheet S being conveyed, so that the front and back orientation of the sheet S to be discharged can be changed freely.

The sheet discharging and stacking module 7000 includes the top tray 7200 and the stacking portion 7500. The sheet discharging and stacking module 7000 aligns and stacks the sheets S conveyed from the reversing module 6000.

<Ink>

The ink contains 0.1 to 20.0 mass % resin component, water and water-soluble organic solvent, colorant, wax, and additives based on the total ink mass.

<Drying Function Portion>

The drying module 3000, which heats and dries the liquid components of the reaction liquid and ink applied to the sheet S, can suppress cockling of the sheet S by heating and drying the reaction liquid and ink to promote evaporation of water in the reaction liquid and ink.

The drying module 3000 can be any device capable of heating and drying, and various conventionally known devices can be used as appropriate, but hot air dryers and heaters are preferred. There are no restrictions on the type of heater, and it is preferable to select and apply a heater from among known methods. Among them, heating with electric heating wires or infrared heaters are preferred from the viewpoint of safety and energy efficiency.

<Passing-Over Unit>

Figure 2:
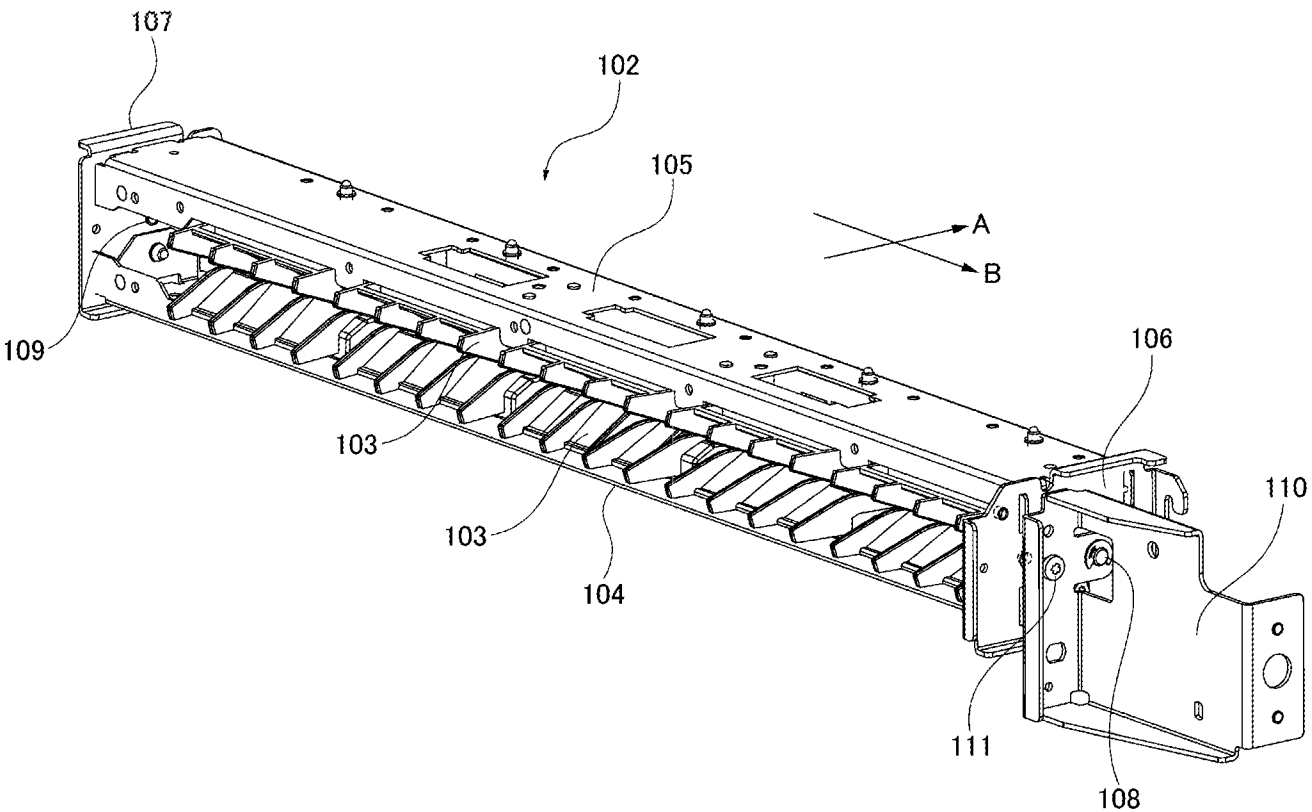
FIG. 2 is a diagram showing the configuration of a passing-over unit for the image forming apparatus.
Figure 3A:
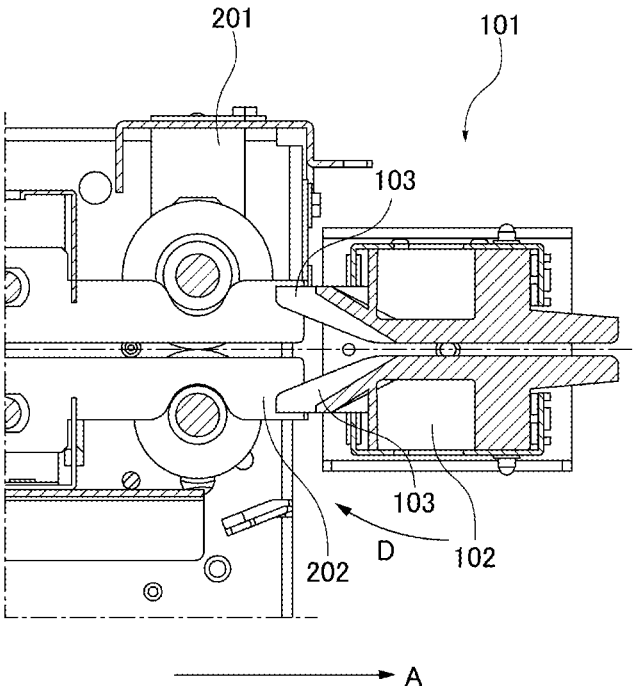
FIGS. 3A and 3B are diagrams for describing an operation of a conveying unit of the image forming apparatus.
Figure 3B:
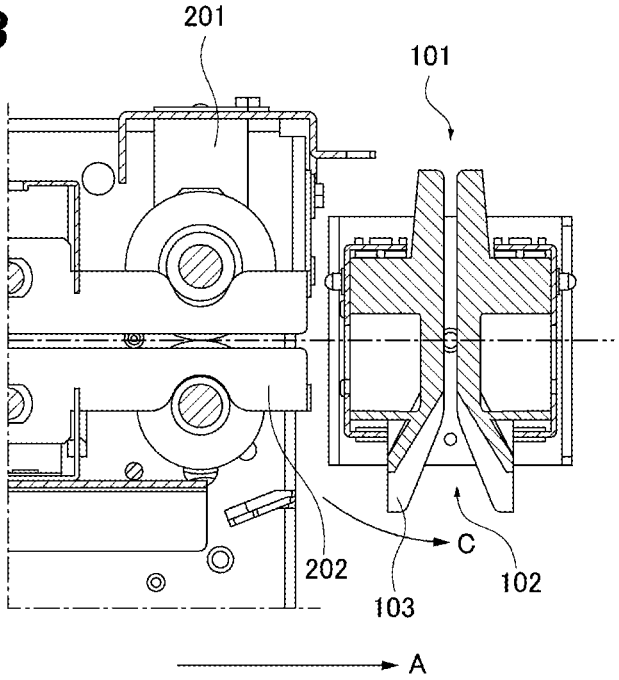
Figure 4:
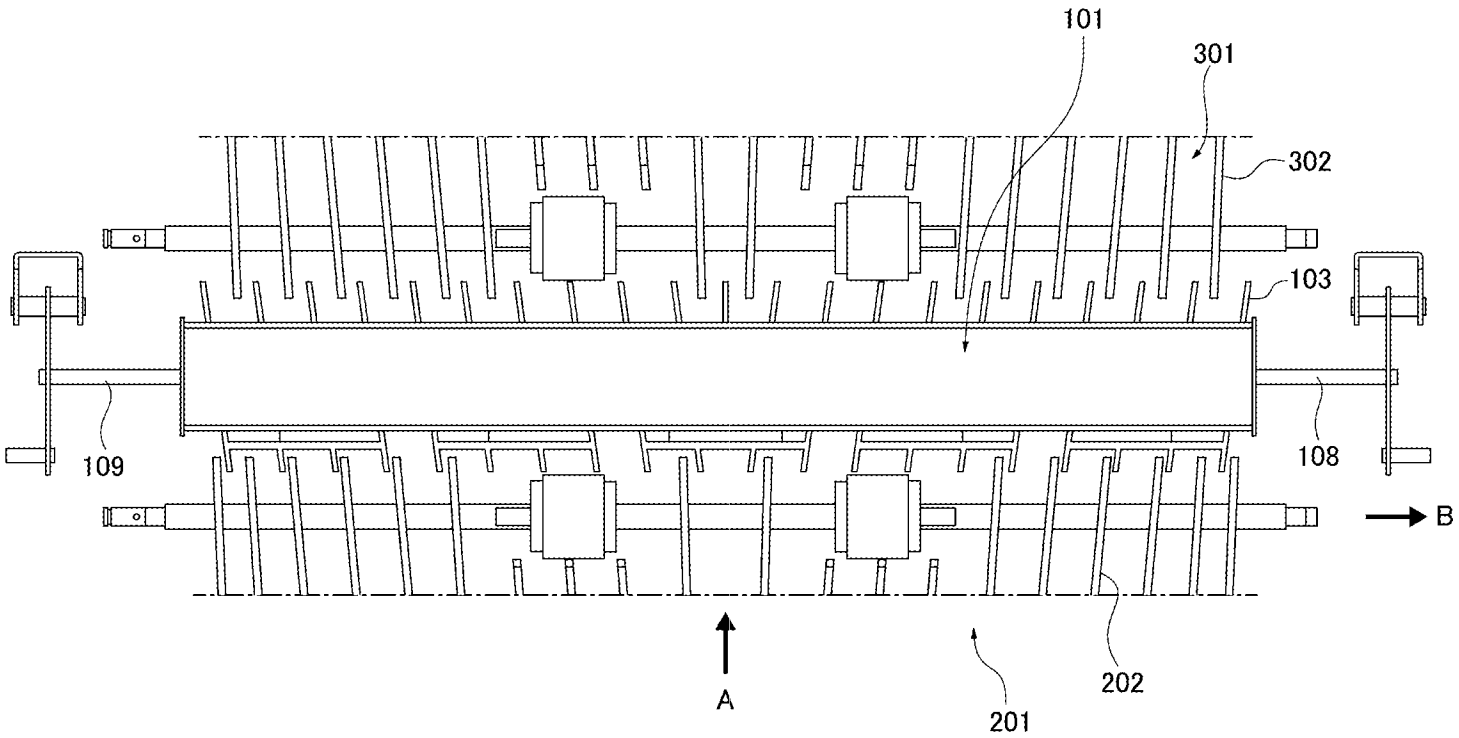
FIG. 4 is a diagram showing a top view of the conveying unit for describing an operation for pulling out the conveying unit.
Figure 5A:
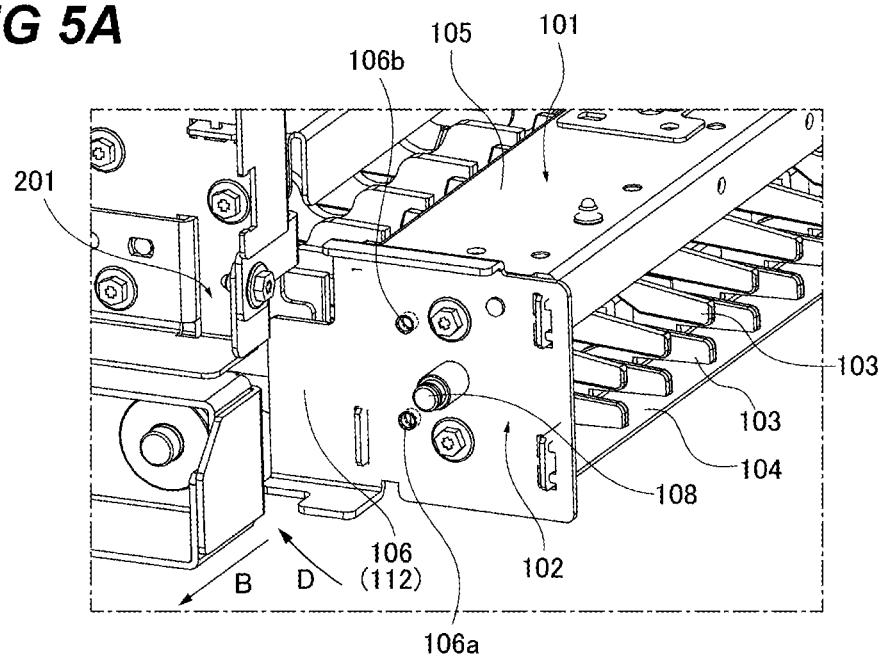
FIGS. 5A and 5B are diagrams showing the passing-over unit for describing an operation of a stopper member of the passing-over unit.
Figure 5B:
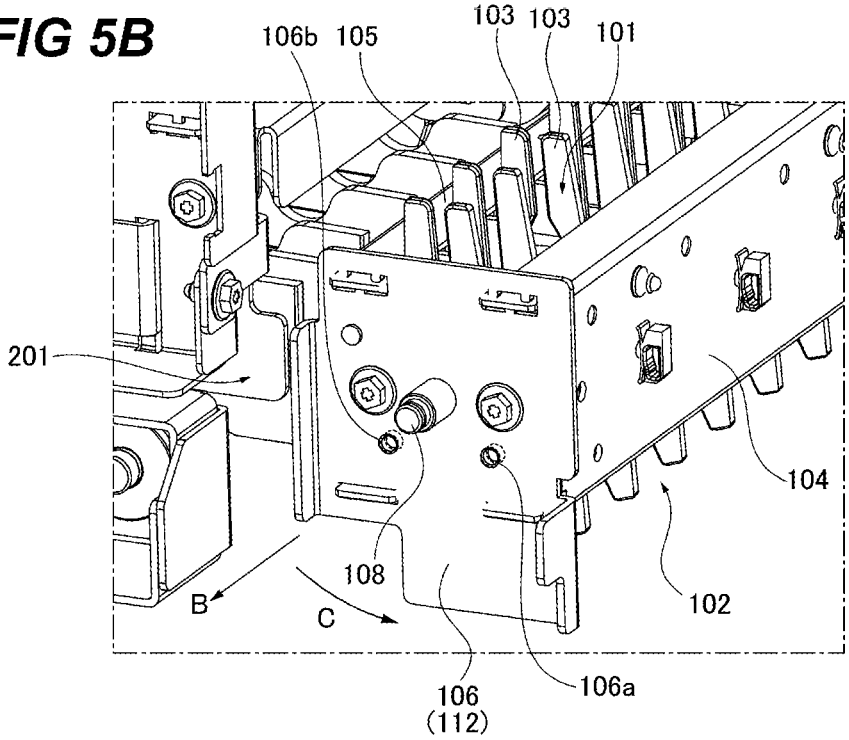

Next, the configuration of the passing-over unit 101 will be described using FIGS. 2 to 5. FIG. 2 is a diagram showing a schematic view of the passing-over unit. FIGS. 3A and 3B are diagrams showing the operation of the passing-over unit relative to the conveying unit. FIG. 4 is a diagram showing a top view for describing the pulling operation of the conveying unit. FIGS. 5A and 5B are diagrams showing the passing-over unit for describing an operation of a stopper member of the passing-over unit.

The inkjet recording apparatus as an image forming apparatus that forms an image on a sheet includes a plurality of modules 1000 to 7000 connected in series in the sheet conveying direction. The multiple modules 1000 to 7000 are separably connected.

The passing-over units 101 are located at the passing-over portions between the various modules of the inkjet recording apparatus. Specifically, each of the passing-over units 101 is located between the cooling module 5000 and the fixing module 4000, between the fixing module 4000 and the drying module 3000, between the drying module 3000 and the printing module 2000, and between the printing module 2000 and the sheet feeding module 1000. Each of the passing-over units 101 is located at the entrance or the exit of the duplex conveying path of each module. The passing-over units 101 located between modules have the same configuration as each other from a cost point of view. As an example, the passing-over unit 101, which is located between the printing module 2000 and the sheet feeding module 1000, and provided at the entrance of the duplex conveying path of the sheet feeding module 1000, will be described in detail here.

The passing-over unit 101 is located on the duplex conveying path of the sheet feeding module 1000 that is the sheet conveying apparatus (second module). The sheet feeding module 1000 is separably connected to the printing module 2000 that is the sheet conveying module (first module). The printing module 2000 is equipped with the conveying unit 201 with the conveying guide 202 on the duplex conveying path (see FIGS. 3A and 3B). The conveying guide 202 guides the sheet S. The conveying guides 202, 202 are arranged to face each other via the sheet S, so that the conveying guides 202, 202 form a conveying path that guides the sheet S. Each of the conveying guides 202, 202 is arranged to face the front surface or the back surface of the sheet. The conveying unit 201 is provided such that the conveying unit 201 can be pulled out from the printing module 2000 in the direction B orthogonal to the conveying direction A of the sheet S (see FIG. 4). The passing-over unit 101 of the sheet feeding module 1000 is located downstream of the conveying unit 201 of the printing module 2000 in the conveying direction.

The configuration shown here is an example where the passing-over unit 101 is located downstream of the conveying unit 201 in the conveying direction, which conveying unit can be pulled out from a module. The embodiment is not limited to this configuration. The passing-over unit may be configured to be located upstream of the conveying unit in the conveying direction, which conveying unit can be pulled from a module.

The passing-over unit 101 passes a sheet over on the duplex conveying path between the printing module 2000 and the sheet feeding module 1000.

As shown in FIG. 2, the passing-over unit 101 includes the rotation central shafts 108, 109, the rotary conveying unit 102 that is rotatable around the rotation central shafts 108, 109 and guides a sheet, and the frame 110 that holds the rotation central shaft 108. The rotary conveying unit 102 includes the conveying guides 103, 103, the guide stays 104, 105, the front side plate 106, and the rear side plate 107.

The conveying guides 103, 103 are arranged to face each other via the sheet S, forming a conveying path that guides the sheet S. The conveying guides 103, 103 are respectively arranged to face the front surface and the back surface of the sheet. The guide stays 104, 105 support each of the conveying guides 103, 103 throughout the almost full lengths in the direction B. The front side plate 106 supports one side of the guide stays 104, 105 in the longitudinal direction (direction B perpendicular to the conveying direction A) and further supports the rotation center shaft 108. The rear side plate 107 supports the other side of the guide stays 104, 105 in the longitudinal direction and the rotation center shaft 109. The rotation center shafts 108, 109 are located on an axis outside the sheet conveying area in which the sheet is guided by the conveying guides 103, 103. The rotation center shafts 108, 109 are supported by the front side plate 106 and the rear side plate 107, respectively.

The rotary conveying unit 102 is provided to be switched between the first position shown in FIG. 3A and the second position shown in FIG. 3B by rotation. This means that the passing-over unit 101 is provided to be switched between the first position shown in FIG. 3A and the second position shown in FIG. 3B by rotation.

The transfer guides 103, 103 of the passing-over unit 101 pass a sheet over in the first position shown in FIG. 3A. In the first position shown in FIG. 3A, the conveying guides 103, 103 of the passing-over unit 101 overlap with the conveying guides 202 of the conveying unit 201 in the conveying direction A. This eliminates the gap between the conveying guides 103, 103 of the passing-over unit 101 and the conveying guide 202 of the conveying unit 201 in the conveying direction A. Further, in the first position shown in FIG. 3A, the conveying guide 103 of the delivery unit 101 overlaps with the conveying guide 202 of the conveying unit 201 in the pulling-out direction B. In contrast, in the second position shown in FIG. 3B, the conveying guide 103 of the delivery unit 101 does not overlap with the conveying guide 202 of the conveying unit 201 in the pulling-out direction B.

The rotary conveying unit 102 is configured to rotate a predetermined angle in the direction of the arrow C or the direction of the arrow D around the rotation central shafts 108, 109. In this embodiment, the rotary conveying unit 102 is switched from the first position shown in FIG. 3A to the second position shown in FIG. 3B by rotating a predetermined angle in the direction of the arrow C, and from the second position to the first position by rotating a predetermined angle in the direction of the arrow D.

<Second Conveying Guide and Second Conveying Unit>

The sheet feeding module 1000 as the second module of the inkjet recording apparatus includes the second conveying guide 302 that guides the sheet across the passing-over unit 101 and on the opposite side of the conveying unit 201 in the conveying direction A of the sheet S (see FIG. 4).

In the first position, in the conveying direction, one side of the conveying guide 103 of the passing-over unit 101 overlaps with the conveying guide 202 of the conveying unit 201 and the other side of the conveying guide 103 overlaps with the second conveying guide 302. This allows the passing-over unit 101 to reliably pass a sheet over in the first position. In contrast, when the conveying guide 103 of the passing-over unit 101 is retracted to the second position, the one side of the conveying guide 103 of the passing-over unit 101 does not overlap with the conveying guide 202 of the conveying unit 201 and the other side of the conveying guide 103 does not overlap with the second conveying guide 302. This allows the conveying unit to be moved in the pulling-out direction without having to move the module in the conveying direction. As a result, maintenance can be performed easily.

Even if the sheet feeding module 1000 is configured to have the second conveying unit 301 (see FIG. 4) with a second conveying guide 302, and to be able to be pulled out in the direction B orthogonal to the sheet conveying direction A, the above configuration of the passing-over unit 101 is still valid. Namely, when the conveying guide 103 of the passing-over unit 101 is retracted to the second position, the one side of the conveying guide 103 of the passing-over unit 101 does not overlap with the conveying guide 202 of the conveying unit 201 and the other side of the conveying guide 103 does not overlap with the second conveying guide 302. This allows the second conveying unit 301 of the sheet feeding module 1000 to be moved in the pulling-out direction B in addition to the conveying unit 201 of the printing module 2000. As a result, maintenance can be performed more easily.

<Rotation Restricting Screw>

As shown in FIG. 2, the passing-over unit 101 has the rotation restricting screw 111 as a rotation restricting member that secures the passing-over unit 101 (rotary conveying unit 102) in the first or second position and restricts its rotation. The rotation restricting screw 111 restricts the rotation of the passing-over unit 101 in the first position shown in FIG. 3A or in the second position shown in FIG. 3B.

The rotation restricting screw 111 is a fastening member that is fastened to the frame 110 as a securing member. The front side plate 106 of the passing-over unit 101 has the fastening hole 106*a* as the first fastening portion to which the rotation restricting screw 111 is fastened in the first position shown in FIG. 3A. Further, the front side plate 106 of the passing-over unit 101 has the fastening hole 106*b* as the second fastening portion to which the rotation restricting screw 111 is fastened in the second position shown in FIG. 3B.

When the rotation restricting screw 111 fastened to the frame 110 is fastened to the first fastening hole 106*a* of the passing-over unit 101, the passing-over unit 101 is secured in the first position shown in FIG. 3A where the rotation of the passing-over unit 101 is restricted. Further, when the rotation restricting screw 111 fastened to the frame 110 is fastened to the first fastening hole 106*b* of the passing-over unit 101, the passing-over unit 101 is secured in the second position shown in FIG. 3B where the rotation of the passing-over unit 101 is restricted.

In this embodiment, as a rotation restricting member that restricts the rotation of the passing-over unit 101, the rotation restricting screw 111 is exemplified, which is a fastening member fastened to the frame 110. However, the rotation restricting member is not limited to the rotation restricting screw. The rotation restricting member may have any other configuration as long as it secures the passing-over unit 101 (rotary conveying unit 102) in the first or second position and restricts its rotation.

<Stopper Member>

The passing-over unit 101 has the stopper member 112 that restricts the movement of the conveying unit 201 in the pulling-out direction B. The stopper member 112 is configured to be able to release the restriction of the movement. When the passing-over unit 101 is secured in the first position as shown in FIG. 3A, the stopper member 112 is positioned overlapping with the conveying unit 201 in the pulling-out direction B and restricts the movement of the conveying unit 201 in the pulling-out direction B. When the passing-over unit 101 is moved to the second position as shown in FIG. 3B, the stopper member 112 is moved to the position in which the stopper member 112 does not overlap with the conveying unit 201 in the pulling-out direction B and releases the restriction of the movement of the conveying unit 201 in the pulling-out direction B.

Here, the rotary conveying unit 102, which supports the conveying guide 103 and rotates around the rotation central shafts 108, 109, serves as the stopper member 112. More specifically, the front side plate 106 (side wall), which is provided on the front side (one side) of the rotary conveying unit 102 in the pulling-out direction B, and is a part of the rotary conveying unit 102, serves as the stopper member 112.

With this configuration, when the rotary conveying unit 102 is secured in the first position and the conveying unit 201 is going to be pulled out, the conveying unit 201 contacts the stopper member 112 before the conveying guide 103 of the rotary conveying unit 102 would contact it. This allows to prevent damage to the conveying guide 103. It is also possible to recognize that the rotary conveying unit 102 of the passing-over unit 101 is not in the correct position (second position) from the fact that the conveying unit 201 cannot be pulled out when the rotary conveying unit 102 is secured in the first position.

In the above description, the configuration is exemplified in which the front side plate 106 provided on one side of the rotary conveying unit 102 in the pulling-out direction B serves as the stopper member 112. This embodiment is not limited to this configuration. For example, it may be configured that the rear side plate 107 provided on the other side serves as the stopper member 112. Although the configuration is exemplified in which the rotary conveying unit 102 serves as the stopper member 112, the stopper member 112 can be provided separately from the rotary conveying unit 102. In this case, the stopper member 112 restricts the movement of the conveying unit 201 in the first position and releases the restriction of the movement of the conveying unit 201 in the second position in conjunction with the position of the rotary conveying unit 102.

If the sheet feeding module 1000 with the passing-over unit 101 is configured to have the aforementioned second conveying unit 301, the rotary conveying unit 102 can be configured to serve as a stopper member for the second conveying unit 301. The same effect can be obtained with this configuration.

<Configuration for Passing a Sheet Over and Maintenance>

The configuration for passing a sheet over to the conveying unit and maintenance of the conveying unit will be described next.

When a sheet is passed over, the rotary conveying unit 102 of the passing-over unit 101 is secured in the first position (sheet passing-over position) shown in FIG. 3A. In the first position, the conveying guide 103 of the passing-over unit 101 overlaps with the conveying guide 202 of the conveying unit 201 in the pulling-out direction B. As a result, the sheet conveyed from the conveying unit 201 can be smoothly and reliably passed over and conveyed in the passing-over portion between modules, since no gaps are created between modules.

When the rotary conveying unit 102 is secured in the first position, the front side plate 106 of the rotary conveying unit 102 is positioned overlapping with the conveying unit 201 in the pulling-out direction B. Further, the front side plate 106 serves as the stopper member 112. As a result, even if the conveying unit 201 is going to be pulled out when the rotary conveying unit 102 is secured in the first position, the conveying unit 201 contacts the stopper member 112 before the conveying guide 103 of the rotary conveying unit 102 would contact it. This allows to prevent damage to the conveying guide 103. It is also possible to recognize that the rotary conveying unit 102 of the passing-over unit 101 is not in the correct position (second position) from the fact that the conveying unit 201 cannot be pulled out when the rotary conveying unit 102 is secured in the first position.

On the other hand, when the conveying unit 201 is pulled out for maintenance, the rotary conveying unit 102 of the passing-over unit 101 is moved to the second position (retracted position) shown in FIG. 3B. The rotation restriction of the rotary conveying unit 102 is released by removing the rotation restricting screw 111 in the first position (sheet passing-over position). After the rotary conveying unit 102, for which the rotation restriction has been released, is moved by rotation to the second position (retracted position), the rotation restricting screw 111 is fastened again. As a result, the rotary conveying unit 102 is secured in the second position and its rotation is restricted again. This also prevents the problem that the rotary conveying unit 102 is unintentionally rotated during the pulling-out operation of the conveying unit 201, causing the conveying guide 103 to come into contact with the conveying unit 201 and to be damaged.

In the second position, the conveying guide 202 does not overlap with the conveying guide 103 in the pulling-out direction B. When the rotary conveying unit 102 is secured in the second position, the front side plate 106 (serving as the stopper member 112) of the rotary conveying unit 102 does not overlap with the conveying unit 201 in the pulling-out direction B. As a result, the conveying unit 201 can be pulled out in the pulling-out direction B even without moving (separating) the module in the conveying direction, enabling easy maintenance.

After the maintenance is completed, the conveying unit 201 is inserted and secured in the regular position. Then, the rotary conveying unit 102 of the passing-over unit 101 is moved from the second position (retracted position) to the first position (sheet passing-over position), and the rotation restricting screw 111 is fastened, to be ready for the sheet conveying again.

When the passing-over unit is placed in the passing-over portion between modules as described above, the conveying guide 103 of the passing-over unit 101 protrudes outward from the frame of the sheet feeding module in the first position. Therefore, the main body of the apparatus can be transported in a state where the conveying guide 103 does not protrude from the main body by rotating and placing the rotary conveying unit 102 to the second position (retracted position) even during transport of the main body. This makes it possible to prevent damage to the conveying guide during transportation of the main body, and to avoid the need for additional parts to prevent the damage.

As shown in FIGS. 3A and 3B, the conveying guide 103 (rotary conveying unit 102) is rotated 90° in the above embodiment. However, the rotation angle of the conveying guide is not limited to this. The rotation angle can be any degrees, not limited to 90°, as long as the conveying guide 202 of the conveying unit 201 does not overlap with the conveying guide 103 of the passing-over unit 101 after the rotation.

As shown in FIGS. 3A and 3B, in the above embodiment, the configuration is exemplified in which the rotary conveying unit 102 is rotated in predetermined directions to switch positions. Specifically, the configuration is exemplified in which the rotary conveying unit 102 is switched to the second position by rotating a predetermined angle in the direction of the arrow C from the first position, and then is switched to the first position by rotating a predetermined angle in the direction of the arrow D from the second position. However, the directions of rotation for switching rotary conveying units are not limited to these ones. For example, the configuration can be adopted in which the rotary conveying unit 102 is switched from the first position to the second position by rotating the rotary conveying unit 102 in either the direction C or the direction D from the first position. When the rotary conveying unit 102 is configured to be able to rotate in both directions, a space must be provided in the range of the 360° rotation of the rotary conveying unit 102. This limits the structures around the rotary conveying unit 102. From this point of view, the embodiment is more preferable in which the rotary conveying unit 102 can be rotated only a predetermined angle in a predetermined direction.

In the above-described embodiment, the configuration is exemplified in which the passing-over unit is placed between modules. Specifically, in the above-described embodiment, the sheet feeding module 1000 and the printing module 2000 are configured to be connected, the printing module 2000 has the conveying unit 201, which can be pulled out from the printing module 2000, and the sheet feeding module 1000 has the passing-over unit 101 that passes a sheet over to and from the conveying unit 201, and the present invention is applied to the sheet feeding module. However, the present invention is not limited to this configuration. For example, the invention can be applied to a single module (sheet conveying apparatus) having a conveying unit that can be pulled out and a passing-over unit that is located upstream or downstream of the conveying unit and that passes a sheet over to and from the conveying unit. The passing-over unit of the sheet conveying apparatus is configured to be able to be switched by rotation between the first and second positions described above. Furthermore, a stopper member is provided that restricts the movement of the conveying unit in the puling-out direction when the passing-over unit is in the first position and releases the restriction of the movement of the conveying unit in the pulling-out direction when the passing-over unit is in the second position. This configuration has the same effect as the above-described embodiment.

The above-described embodiment exemplifies an inkjet recording apparatus as an image forming apparatus having multiple modules connected together, including a printing module and a sheet feeding module. Further, in the above-described embodiment, the sheet feeding module is connected to the printing module, the printing module has the conveying unit that can be pulled out, and the sheet feeding module has the passing-over unit that passes a sheet over to and from the conveying unit, and the invention is applied to the sheet feeding module. However, the present invention is not limited to this configuration. The same effect can be obtained by providing the passing-over unit in another module other than the sheet feeding module among the multiple modules of the inkjet recording apparatus and by applying the present invention to the another module.

In the above-described embodiment, the inkjet system is exemplified as the recording system, but the recording system is not limited to inkjet system, and other recording systems such as electrophotographic system, for example, are also acceptable.

According to the present invention, maintenance can be more easily performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-067802, filed Apr. 18, 2023, which is hereby incorporated by reference herein in its entirety.

What is claimed is:

1. A sheet conveying apparatus to which a sheet conveying module is separably connected, the sheet conveying module being provided with a conveying unit including a conveying guide configured to guide a sheet, the conveying unit being able to be pulled out in a pulling-out direction perpendicular to a sheet conveying direction, the sheet conveying apparatus comprising:

a passing-over unit configured to pass the sheet over between the sheet conveying module and the sheet conveying apparatus, the passing-over unit including a rotation central shaft and a conveying guide configured to guide the sheet and to be rotatable around the rotation central shaft, the passing-over unit being arranged on an upstream side or a downstream side of the conveying unit in the sheet conveying direction, wherein the passing-over unit is configured to be switched by rotation between a first position and a second position, the sheet is passed over in the first position of the passing-over unit, the conveying guide of the passing-over unit overlaps with the conveying guide of the conveying unit in the pulling-out direction when the passing-over unit is in the first position, and the conveying guide of the passing-over unit does not overlap with the conveying guide of the conveying unit in the pulling-out direction when the passing-over unit is in the second position, wherein a stopper member is provided, which is configured to restrict a movement of the conveying unit in the pulling-out direction when the passing-over unit is in the first position, and the restriction by the stopper member to restrict the movement of the conveying unit in the pulling-out direction is released when the passing-over unit is in the second position, wherein the sheet conveying apparatus includes a rotation restricting member that restricts rotation of the passing-over unit by engaging with the passing-over unit, and wherein, in a case where the rotation restricting member restricts the rotation of the passing-over unit when the passing-over unit is in the first position, the stopper member restricts the movement of the conveying unit in the pulling-out direction and the restriction by the stopper member is not released unless the restriction by the rotation restricting member is released.

2. The sheet conveying apparatus according to claim 1, wherein when the passing-over unit is in the first position, the stopper member is arranged in a position where the stopper member overlaps with the conveying unit in the pulling-out direction to restrict the movement of the conveying unit in the pulling-out direction, and wherein when the passing-over unit is moved to the second position, the stopper member is moved to a position where the stopper member does not overlap with the conveying unit in the pulling-out direction to release the restriction of the stopper member to restrict the movement of the conveying unit in the pulling-out direction.

3. The sheet conveying apparatus according to claim 1, wherein the passing-over unit includes a rotary conveying unit that rotates around the rotation center shaft and supports the conveying guide, and wherein the rotary conveying unit serves as the stopper member.

4. The sheet conveying apparatus according to claim 3, wherein the rotary conveying unit has a side wall provided at one side or the other side of the rotary conveying unit in the pulling-out direction, and wherein the side wall serves as the stopper member.

5. The sheet conveying apparatus according to claim 1, wherein the rotation restricting member is a fastening member to be fastened to a securing member, and wherein the passing-over unit includes a first fastening portion to which the fastening member is fastened when the passing-over unit is in the first position and a second fastening portion to which the fastening member is fastened when the passing-over unit is in the second position.

6. The sheet conveying apparatus according to claim 1, wherein the sheet conveying apparatus includes a second conveying guide configured to guide the sheet, the second conveying guide is provided on a side opposite the conveying unit with respect to the passing-over unit in the sheet conveying direction, wherein the passing-over unit is configured to be switched by rotation between the first position and the second position, wherein when the passing-over unit is in the first position, one side of the conveying guide of the passing-over unit overlaps with the conveying guide of the conveying unit in the sheet conveying direction and the other side of the conveying guide of the passing-over unit overlaps with the second conveying guide, and wherein when the passing-over unit is in the second position, the one side of the conveying guide of the passing-over unit does not overlap with the conveying guide of the conveying unit and the other side of the conveying guide of the passing-over unit does not overlap with the second conveying guide.

7. The conveying apparatus according to claim 6, wherein the sheet conveying apparatus includes a second conveying unit configured to guide the sheet, the conveying unit being able to be pulled out in the pulling-out direction perpendicular to the sheet conveying direction.

8. A sheet conveying apparatus comprising:

a conveying unit that includes a conveying guide configured to guide a sheet, the conveying unit being able to be pulled out in a pulling-out direction perpendicular to a sheet conveying direction; and a passing-over unit configured to pass the sheet over to and from the conveying guide of the conveying unit, the passing-over unit including a rotation central shaft and a conveying guide configured to guide the sheet and to be rotatable around the rotation central shaft, the passing-over unit being arranged on an upstream side or a downstream side of the conveying unit in the sheet conveying direction, wherein the passing-over unit is configured to be switched by rotation between a first position and a second position, the sheet is passed over in the first position of the passing-over unit, the conveying guide of the passing-over unit overlaps with the conveying guide of the conveying unit in the pulling-out direction when the passing-over unit is in the first position, and the conveying guide of the passing-over unit does not overlap with the conveying guide of the conveying unit in the pulling-out direction when the passing-over unit is in the second position, wherein a stopper member is provided, which is configured to restrict a movement of the conveying unit in the pulling-out direction when the passing-over unit is in the first position, and the restriction by the stopper member to restrict the movement of the conveying unit in the pulling-out direction is released when the passing-over unit is in the second position, wherein the sheet conveying apparatus includes a rotation restricting member that restricts rotation of the passing-over unit by engaging with the passing-over unit, and wherein, in a case where the rotation restricting member restricts the rotation of the passing-over unit when the passing-over unit is in the first position, the stopper member restricts the movement of the conveying unit in the pulling-out direction and the restriction by the stopper member is not released unless the restriction by the rotation restricting member is released.

9. The sheet conveying apparatus according to claim 8, wherein when the passing-over unit is in the first position, the stopper member is arranged in a position where the stopper member overlaps with the conveying unit in the pulling-out direction to restrict the movement of the conveying unit in the pulling-out direction, and wherein when the passing-over unit is moved to the second position, the stopper member is moved to a position where the stopper member does not overlap with the conveying unit in the pulling-out direction to release the restriction of the stopper member to restrict the movement of the conveying unit in the pulling-out direction.

10. The sheet conveying apparatus according to claim 8, wherein the passing-over unit includes a rotary conveying unit that rotates around the rotation center shaft and supports the conveying guide, and wherein the rotary conveying unit serves as the stopper member.

11. The sheet conveying apparatus according to claim 10, wherein the rotary conveying unit has a side wall provided at one side or the other side of the rotary conveying unit in the pulling-out direction, and wherein the side wall serves as the stopper member.

12. The sheet conveying apparatus according to claim 8, wherein the rotation restricting member is a fastening member to be fastened to a securing member, and wherein the passing-over unit includes a first fastening portion to which the fastening member is fastened when the passing-over unit is in the first position and a second fastening portion to which the fastening member is fastened when the passing-over unit is in the second position.

13. An image forming apparatus that forms an image on a sheet and has multiple modules connected together, the image forming apparatus comprising:

a first module provided with a conveying unit including a conveying guide configured to guide the sheet, the conveying unit being able to be pulled out in a pulling-out direction perpendicular to a sheet conveying direction; and a second module to which the first module is separably connected, the second module including a passing-over unit configured to pass the sheet over between the first module and the second module, the passing-over unit including a rotation central shaft and a conveying guide configured to guide the sheet and to be rotatable around the rotation central shaft, the passing-over unit being arranged on an upstream side or a downstream side of the conveying unit in the sheet conveying direction, wherein the passing-over unit is configured to be switched by rotation between a first position and a second position, the sheet is passed over in the first position of the passing-over unit, the conveying guide of the passing-over unit overlaps with the conveying guide of the conveying unit in the pulling-out direction when the passing-over unit is in the first position, and the conveying guide of the passing-over unit does not overlap with the conveying guide of the conveying unit in the pulling-out direction when the passing-over unit is in the second position, wherein a stopper member is provided, which is configured to restrict a movement of the conveying unit in the pulling-out direction when the passing-over unit is in the first position, and the restriction by the stopper member to restrict the movement of the conveying unit in the pulling-out direction is released when the passing-over unit is in the second position, wherein the sheet conveying apparatus includes a rotation restricting member that restricts rotation of the passing-over unit by engaging with the passing-over unit, and wherein, in a case where the rotation restricting member restricts the rotation of the passing-over unit when the passing-over unit is in the first position, the stopper member restricts the movement of the conveying unit in the pulling-out direction and the restriction by the stopper member is not released unless the restriction by the rotation restricting member is released.

14. The image forming apparatus according to claim 13, wherein when the passing-over unit is in the first position, the stopper member is arranged in a position where the stopper member overlaps with the conveying unit in the pulling-out direction to restrict the movement of the conveying unit in the pulling-out direction, and wherein when the passing-over unit is moved to the second position, the stopper member is moved to a position where the stopper member does not overlap with the conveying unit in the pulling-out direction to release the restriction of the stopper member to restrict the movement of the conveying unit in the pulling-out direction.

15. The image forming apparatus according to claim 13, wherein the passing-over unit includes a rotary conveying unit that rotates around the rotation center shaft and supports the conveying guide, and wherein the rotary conveying unit serves as the stopper member.

16. The image forming apparatus according to claim 15, wherein the rotary conveying unit has a side wall provided at one side or the other side of the rotary conveying unit in the pulling-out direction, and wherein the side wall serves as the stopper member.

17. The image forming apparatus according to claim 13, wherein the rotation restricting member is a fastening member to be fastened to a securing member, and wherein the passing-over unit includes a first fastening portion to which the fastening member is fastened when the passing-over unit is in the first position and a second fastening portion to which the fastening member is fastened when the passing-over unit is in the second position.

* * * * *